United States Patent [19]

Hamilton

[11] 4,220,213

[45] Sep. 2, 1980

[54] METHOD AND APPARATUS FOR SELF ORIENTING A DRILL STRING WHILE DRILLING A WELL BORE

[76] Inventor: Jack E. Hamilton, P.O. Box 686, Hammond, La. 70404

[21] Appl. No.: 967,386

[22] Filed: Dec. 7, 1978

[51] Int. Cl.[2] ..... E21B 7/08; E21B 7/10

[52] U.S. Cl. ..... 175/45; 175/61; 175/73; 175/325

[58] Field of Search ..... 175/325, 73, 76, 61, 175/221, 40, 45

[56] References Cited

U.S. PATENT DOCUMENTS

| | | | |
|---|---|---|---|
| 2,712,434 | 7/1955 | Giles et al. | 175/73 |
| 3,092,188 | 6/1963 | Farris et al. | 175/61 X |
| 3,306,378 | 2/1967 | Williams, Jr. | 175/325 |
| 3,454,308 | 7/1969 | Kennedy | 175/325 X |
| 3,880,246 | 4/1975 | Farris | 175/73 X |
| 3,982,594 | 9/1976 | Berthiaume | 175/325 X |
| 4,076,084 | 2/1978 | Tighe | 175/61 X |
| 4,102,552 | 7/1978 | Kellner | 175/325 X |

FOREIGN PATENT DOCUMENTS

| | | | |
|---|---|---|---|
| 130011 | 3/1960 | U.S.S.R. | 175/73 |

*Primary Examiner*—Stephen J. Novosad
*Attorney, Agent, or Firm*—Jack W. Hayden

[57] ABSTRACT

The low side of a well bore drilled by a rotary drill string with a drill bit thereon is instrumentally determined as to direction and inclination. An eccentric tubular member is rotatably supported on the drill string and is provided with projection means extending beyond the drill bit diameter and lowered into the well bore. The eccentric tubular member rotates so that the heavy side thereof rests on the low side of the well bore and positions the projection thereon in a predetermined circumferentially spaced and angular relationship relative to the low side of the well bore so that the projection engages the well bore wall during drilling operations and urges the bit laterally of the well bore.

During drilling operations, the projection means assumes authority over the drill bit since it extends beyond the diameter of the drilling bit and thus positions the drilling bit laterally in the well bore in a predetermined manner as the drill string is rotated to drill the well bore.

The self orienting directional drilling control arrangement includes the eccentric member, support means to support the member in the drill string for relative rotation therebetween and the projection means on the eccentric member which is circumferentially spaced relative to the heavy side thereof and extends radially beyond the drill bit diameter which is secured in the drill string.

10 Claims, 4 Drawing Figures

METHOD AND APPARATUS FOR SELF ORIENTING A DRILL STRING WHILE DRILLING A WELL BORE

BACKGROUND AND SUMMARY OF THE INVENTION

During the process of drilling a well bore there are constant, yet variable, forces applied to the drill bit and the drill string assembly which may induce deviation of the drill bit and drill string from a true and steady directional course as the bit penetrates the formation being drilled. A few of the forces applied are from such sources as the dip of the formation being drilled or bored; the weight applied on the drill bit during penetration; the revolutions per minute of the drilling bit while penetrating the formation; the types of changing formations being penetrated; the angle of the well bore being drilled by the drill bit; and the like.

In an attempt to reduce if not eliminate the drilling bit from responding to these multiple and varying forces, it has been customary to develop as much rigidity as possible in the lower part of the drill string as close to the drill bit as possible. Numerous devices have been proposed and used in such attempts. For example drill pipe stabilizers have been inserted at intervals in the section of the drill string next to the drill bit to limit the lateral freedom of movement of the drill bit and thus limit the response of the drill bit to the forces which cause the deviation.

At the present time, the accepted means of limiting deviation of the course of a well bore while being drilled is by using as many drill pipe stabilizers as possible in the drill string which are arranged at longitudinally spaced intervals or otherwise suitably positioned as desired in the drill string. This has limited the course of the well bore to some extent but the use of stabilizers in the drill string does not and cannot eliminate all of the freedom of the drill bit and drill string and therefore the drill string and bit still continues to respond to the forces which induce deviation from a desired true and steady course.

The drill pipe stabilizers generally consist of a tubular body connected into the drill string with a number of radially extending, and circumferentially spaced blade members fixed to the tubular body. However, so far as known to applicant the furtherest extension of the blades is and has been to be of the same outer diameter of the drill bit but not beyond that perimeter diameter. For example, when a $9\frac{7}{8}''$ drilling bit is used to drill a well bore, and drill pipe stabilizers are installed in the drill string to limit deviation, the maximum perimeter diameter of the stabilizers is also $9\frac{7}{8}''$ or the same, but not more, as the perimeter diameter of the drilling bit. To date the oil and gas drilling industry has accepted the so called stabilized drill string, as above generally described, as the best partial answer to the problem of well bore deviation. Therefore, industry wide, and so far as known to applicant well bores are presently being drilled using the stabilized drill string for an attempt at control of well bore deviation. When the stabilized drill string is employed, the well bore is drilled to a depth until it has drifted far enough from its true intended course to necessitate stopping the well bore penetration until a course correction tool can be employed to turn, or correct, the course of the well bore back to its original true and intended course. Then when the course of the well bore is corrected the drilling string, with stabilizers for rigidity, are again lowered into the well bore with the drill bit thereon to continue penetration of the well bore. The depth of the well bore being drilled and the combined efforts of the forces of deviation being applied to the drill bit, may make it necessary to cease drilling the well bore, remove the well string, run correctional tools, and then relower the drill string after each run of the correction tool several times before the well bore is drilled to its intended depth and/or bottom hole location.

Of course it can be appreciated that quite a number of stabilizers are required at the well site in employing the above described procedure. There are many threaded connections required to make up the drill string thus creating possibilities of pipe thread failures and there is an expensive rig time cost in installing the stabilizers in the drill string. The most noticeable fact being, so far as known to applicant that only partial success in controlling well bore deviation is achieved in using the stabilized drill string arrangement above described.

One of the objects of the invention of the present method and apparatus is to provide a new and improved method of controlling and eliminating well bore deviation by removing all authority of the drilling bit and reducing if not completely disallowing response of the drill bit to the forces applied that induce deviation of the drilling bit as the well bore is being drilled.

Another object of the method and apparatus of the present invention is to eliminate the need for ceasing or interrupting the penetration of the well bore for course correction by employing overwhelming control over the drilling bit and not allowing it freedom to deviate.

A further object of the method and apparatus of the present invention is to eliminate the need for excessive numbers of stabilizers in the drill string in an attempt to utilize their rigidity to control the course of the well bore. They have but a limited control over the bit and do not provide a complete and satisfactory answer to the problem of hole deviation. It is one of the objects of this method and invention to eliminate harmful doglegs in the well bore to insure a more workable well bore for such wireline operations as surveying the well bore, elimination of the doglegs reduces wear of the casing and tubing installed in the well bore for production purposes after the well has been drilled and completed.

Still another object of the invention is provide a method and apparatus which orients and maintains a desired orientation of a drill string and drill bit connected thereto as drilling of the well bore progresses.

Yet a further object of the present invention is to provide an arrangement in a drill string which seeks the low side of the well bore and includes projection means extending radially beyond the drilling bit diameter for engaging the well bore wall and urging the drill bit in a manner to realign the well bore as it is drilled.

Other objects and advantages of the invention will become apparent from a consideration of the following drawings and written description.

DESCRIPTION OF THE PREFERRED EMBODIMENT

Figure 1:
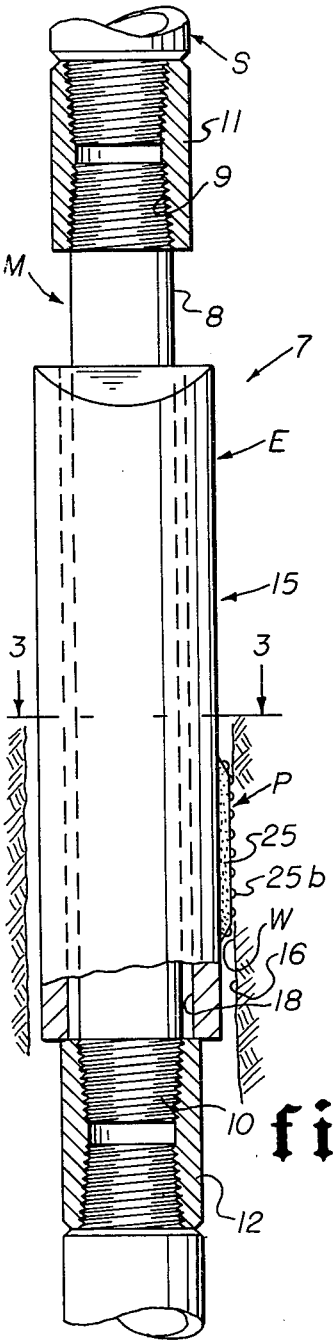
FIG. 1 is a side view, partly in section, illustrating a form of the arrangement of the present invention.

Attention is first directed to FIG. 1 of the drawings wherein one form of arrangement is illustrated which may be employed in practicing the method of the present invention to self orient the drill string and drill bit thereon while drilling a well bore. The drill string may be referred to generally by the letter S in which an eccentric member referred to generally by the letter E is supported. The eccentric member E is secured or connected into the drill string S by support means referred to generally by the letter M for accommodating relative rotation therebetween, and if desired, relative longitudinal movement therebetween.

Projection means P are provided on the eccentric member E which extend radially beyond the outer diameter of the drill bit referred to generally by the letter B. The projection means P engages the wall W of well bore 16 to urge the drill string S and drill bit B laterally of the well bore 16 as it is drilled.

The specific form of the arrangement for practicing the present invention is referred to generally by the numeral 7 and is shown as including a mandrel 8 having threads 9 and 10 adjacent each end thereof for connecting the mandrel in the drill string S. The eccentric member E is in the form of a cylindrical member referred to generally at 15 and is received and supported on the mandrel 8 as illustrated in the drawings. Generally, it is preferred that the eccentric member E be in the form of the cylindrical member 15 and be of less longtiudinal extent than the mandrel 8 on which it is carried. It will be noted that the cylindrical member 15 is provided with an eccentric bore 18 extending longitudinally thereof and through which the mandrel 8 extends as shown in the drawings to accommodate relative rotation between the eccentric member E, or cylindrical member 15, and the drill string S in which the arrangement referred to generally at 7 is carried.

In assembly, the eccentric member E may be first positioned on the mandrel 8, and the threaded couplings 11 and 12 then engaged with the threads 9 and 10 formed on each end of the mandrel; the couplings may then be threadedly engaged with drill string S as shown in the drawings. The mandrel 8 in the form of the assembly shown in FIG. 1 is of greater longitudinal extent than cylindrical member 15, thus accommodating relative longitudinal movement of the drill string S while member 15, through projection P, remains engaged with the well bore wall W. The couplings 11 and 12 also serve to limit or restrict longitudinal movement of the drill string S relative to the eccentric member E.

In another form of the device, the eccentric member E, in the form of a cylindrical member 15 as illustrated in FIG. 1 may be mounted on the drill string by suitable sealed bearing means at each end of the cylindrical member 15 to accommodate relative rotation between the drill string S and the cylindrical member 15 rotatably carried therein. In such form it can be appreciated that, if desired, the eccentric member E could move longitudinally with the drill string S as the well bore 16 is deepened.

Figure 4:
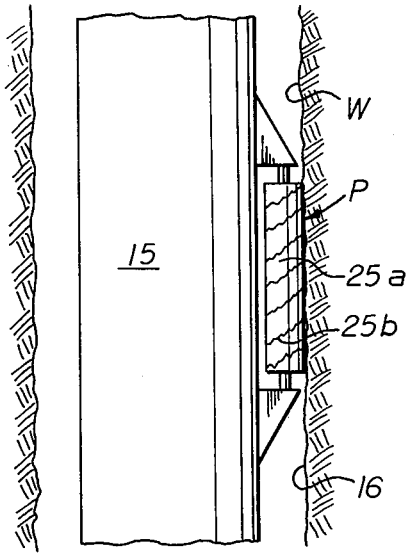
FIG. 4 is a side elevational view illustrating roller means as the projection means on the eccentric member.

Projection means P in the form of a longitudinal and radially extending blade or member 25 is mounted on the eccentric member E, which member 25 in the form of the arrangement illustrated in the drawings is not only shown as extending longitudinally of the cylindrical member 15 and in the form illustrated comprises a single blade, but it also extends radially beyond the outer diameter of the bit B. It can be appreciated that the projection means P may comprise a plurality of longitudinally extending projections, or may comprise one or more rollers **25*a* arranged longitudinally on the cylindrical member 15 to engage the well bore wall and urge the drill string S and drill bit B carried thereon laterally of the well bore 16 as shown in FIG. 4. Regardless of the form of the projection means P, such projection means P extends or projects radially outwardly of the cylindrical member 15** an amount greater than the diameter of the drill bit B thereon.

Figure 3:
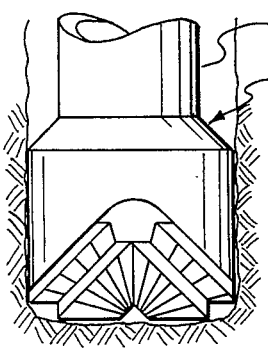
FIG. 3 is a sectional view on the line 3—3 of FIG. 1 illustrating the eccentric member resting on the low side of the well bore with the projection means thereon extending radially beyond the diameter of the bit for engaging the well bore wall to urge the drill string and drill bit laterally of the well bore during drilling operations.
Figure 3:
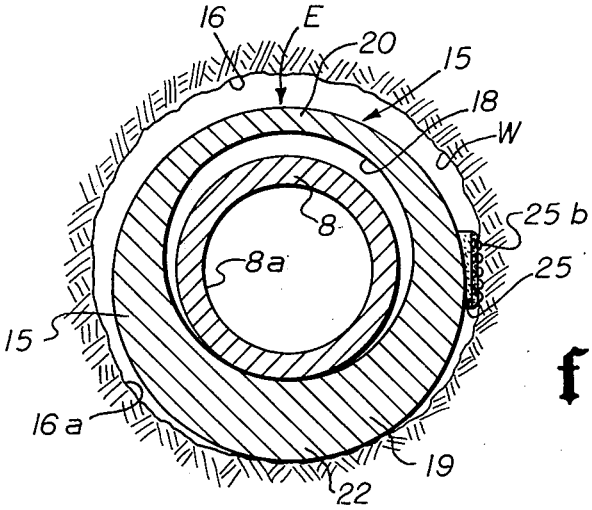

The eccentric bore 18 in the cylindrical member 15 provides a wall portion 19 in the cylindrical member 15 which is thicker than the wall portion 20 as better seen in FIG. 3. It can be appreciated that the wall portions 19 and 20 extend circumferentially and longitudinally of the cylindrical member 15 and the portion 19 forms a heavier body portion in the cylindrical member 15, which heavier body portion is represented at 22 in FIG. 3 of the drawings. If the portion of the drill string S including the eccentric member E, become inclined off vertical during drilling operations, the force of gravity act upon the cylindrical member 15 so that the heavier portion 22 thereon moves around the mandrel 8 to the underside or low side of the well bore 16. Since the eccentric member E or sleeve member 15 is rotatably mounted on the drill string, the heavier portion 22 thereof will remain on the low side of the well bore as the drill string is rotated.

Figure 2:
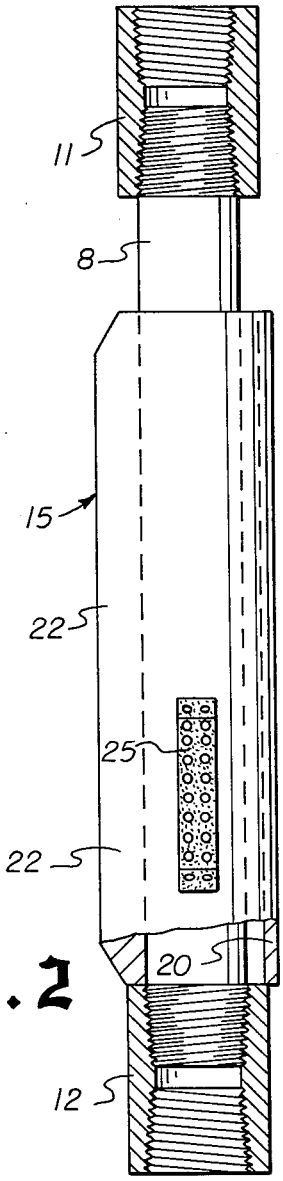
FIG. 2 is a side elevational view, partly in section, illustrating in greater detail one form of the eccentric member and a means for rotatably supporting it in a drill string.

The projection means P is offset circumferentially relative to the heavier wall portion 22 of the eccentric member E as illustrated more clearly in FIGS. 2 and 3 of the drawings. Generally, it will be offset to the right of such heavier portion when the drill string and well bore are viewed in a vertical section and looking downwardly on the well bore, drill string and drill bit as seen in FIG. 3. The projection means P forms a bearing member that engages the wall W of the well bore 16 before the bit so that the bit cannot reach the wall W of the well bore 16 on the side or section of the well bore 16 where the projection means P has contact.

The projection means P may be of any suitable surface bearing means such as knob, block roller or blade. It can also be secured to the member 15 by suitable means such as screws or the like whereby it may be readily removed or the projection means P may be permanently secured to the member.

If desired the projection means P may be provided with a wear resistant surface portion **25*b*** formed of tungsten carbide or other suitable hard surfacing material to inhibit wear thereof as the well bore is drilled progressively deeper.

The direction of deviation of the well bore 16 being drilled is determined in the first instance by drilling a short distance with an ordinary drilling assembly and if for example the well bore 16 is being influenced to walk or deviate to the right of its intended course, then the projection means P on the eccentric member E, is placed on the right side, or offset circumferentially to the right of the heavier portion 22 as viewed in looking down the well bore as illustrated in FIG. 3 to overcome the deviation in the well bore 16. The well bore deviation may be determined instrumentally by means well known in the art. Although the one side of the eccentric member E on which the projection means P is formed is extended so that its radius is beyond the radius of the drilling bit B, the opposite side of the eccentric member E, is less than the radius of the drilling bit B and allows lateral movement of the drilling bit in the well bore in such direction.

As the well bore 16 is drilled by rotating the drill string S and the drill bit B, the cylindrical member 15 may slide down the well bore 16 while the projection means P maintains contact therewith. This prevents the drill bit B from moving laterally of the well bore in the direction towards the projection means 25.

By way of further example, if a well bore is being drilled and a drill bit B employed which is $9\frac{7}{8}''$ in diameter, then the diameter of the eccentric member E including the projection means P preferably would be at least, by way of example, $10\frac{1}{4}''$ in diameter. Of course the exact amount of oversize of the projection means P would be determined by the diameter of the well bore 16.

It can also be appreciated that a person skilled in the art may desire to offset the projection means P relative to the heavy portion 22 other than to the right, or other than approximately 90° as illustrated in FIG. 3. In some instances the circumferential offset of the projection means P may be less than 90°, and in some instances the projection means P may be offset circumferentially to the left of the heavy portion 22 as viewed in FIG. 3. Ordinarily, however, the bit B has a tendency to walk to the right due to the forces applied thereto so that the well bore deviation is in a direction which requires that the projection means P be offset circumferentially to the right of the heavy portion 22 of the eccentric member E, as illustrated in FIG. 3 of the drawings. In employing the present invention, the deviation or inclination of the low side of the well bore 16 may be instrumentally noted or determined by any one of several means well known in the art. For example, a survey of the well bore is taken as it is drilled by means well known in the art. If the hole is drilled 600 feet and walks 6° in the 600 feet drilled, this indicates a 1° walk per 100 foot and in most cases it's to the right because the dip of the formation, with weight applied on the bit, the RPM to rotate and many other factors create these inducements to walk. The present invention is then secured in the drill string S. The eccentric tubular member E is rotatably supported on the drill string S and is provided with projection means P so that the eccentric member E and the projection means P thereon are of larger diameter than the diameter of the bit employed in the drill string S for drilling the well bore 16. The outer diameter of the eccentric member E and projection means P is at least the diameter of the well bore 16, which is generally larger than the diameter of the bit B. Projection means P engage the well bore wall W after the eccentric member E has rotated to enable the heavy portion 22 thereof to seat or rest on the low side of the well bore. This then urges the drill bit B and drill string S laterally of the well bore in a manner to reorient the drill string S and prevent it from continuing to move in an undesired direction.

From the foregoing it can be seen that the cylindrical member 15 will always seek the low side of the well bore and position the projection means P whereby the drill string S and bit B connected therewith are moved laterally to tend to offset the deflection of the well bore during drilling operations.

The foregoing disclosure and description of the invention are illustrative and explanatory thereof, and various changes in the size, shape, and materials as well as in the details of the illustrated construction may be made without departing from the spirit of the invention.

What is claimed is:

1. A method of maintaining movement of a rotary drill string and drill bit thereon in a predetermined manner in a well bore comprising the steps of:

a. instrumentally determining the low side of the well bore;

b. securing on the drill string above the drill bit an eccentric tubular member which accommodates rotational movement between the drill string and the member and which member includes a heavier wall portion with projection means offset circumferentially relative to the heavier wall portion and extending beyond the drill bit diameter for engaging the well bore wall at a position circumferentially spaced from the low side of the well bore to urge the drill bit and drill string in a predetermined manner; and c. lowering the drill string with the eccentric tubular member and drill bit into the well bore whereupon the heavier portion of the tubular member rotates to the low side of the well bore to engage the projection means with the well bore wall for positioning the drill bit in a desired manner as it is rotated by the drill string to drill the well bore.

2. A method of controlling the direction of a well bore as a drill string with a drill bit is rotated comprising the steps of:

a. instrumentally determining the low side of the well bore;

b. lowering a drill string in the well bore with an eccentric tubular member thereon having a heavier wall portion and radial projection means extending beyond the drill bit diameter offset circumferentially relative to the heavier wall portion;

c. positioning the eccentric tubular member in the well bore whereby its heavy wall portion seeks the low side of the well bore while the projection means engages the well bore wall in circumferentially spaced relation to low side of the well bore; and d. rotating the drill string while maintaining the tubular member in the above stated position whereby the drill bit is urged laterally of the well bore as it and the drill string are rotated relative to the eccentric tubular member.

3. A self orienting drilling control arrangement for use with a rotary drill string having a drill bit thereon to drill a well bore including:

a. an eccentric member said eccentric member being formed by a tubular member having a longitudinal bore which is eccentric to the longitudinal axis of the member to form a circumferential portion on the member which is heavier than the remainder of the circumferential portion of the member;

b. support means supporting said member in the drill string for relative rotation therebetween;

c. projection means on said member projecting radially beyond the drill bit diameter for contacting the well bore and urging the drill bit in a predetermined manner as the drill string is rotated to drill the well bore; and d. said projection means being a single longitudinally extending member offset circumferentially a predetermined amount in relation to said heavier circumferential portion.

4. The invention of claim 3 wherein said projection means is removably secured to said member.

5. The invention of claim 3 wherein said projection means is provided with wear resistant surface means for engaging the well bore.

6. The invention of claim 3 wherein said projection means is in the form of roller means.

7. The invention of claim 3 wherein said support means includes a longitudinally extending mandrel for connection in the drill string.

8. The invention of claim 7 wherein the longitudinal extent of said mandrel is greater than that of said member.

9. The invention of claim 8 wherein couplings are threadedly secured to said mandrel for engagement with the drill string.

10. The invention of claim 8 wherein said mandrel is provided with a member at one end and a female member at the other end for threadedly connecting said mandrel into the drill string.

* * * * *